United States Patent [19]

Wirth et al.

[11] 3,942,721

[45] Mar. 9, 1976

[54] FLUIDIZED POWDER FEED SYSTEM FOR ROTARY DISTRIBUTOR OF ELECTROSTATIC COATING APPARATUS

[75] Inventors: Hermann Wirth, Gundelfingen; Lothar Müller, Giengen, both of Germany

[73] Assignee: Robert Bosch GmbH, Stuttgart, Germany

[22] Filed: Mar. 28, 1975

[21] Appl. No.: 563,076

[30] Foreign Application Priority Data

Apr. 3, 1974 Germany ..... 2416081

[52] U.S. Cl. ..... 239/15; 118/308; 118/626; 239/688

[51] Int. Cl.[2] ..... B05B 5/02

[58] Field of Search ..... 118/626, 303, 308, 312, 118/DIG. 5; 239/3, 15, 681–688; 427/27, 30, 31

[56] References Cited

UNITED STATES PATENTS

| | | | |
|---|---|---|---|
| 2,976,175 | 3/1961 | Reindl | 427/30 |
| 3,004,861 | 10/1961 | Davis | 118/DIG. 5 |
| 3,469,718 | 9/1969 | Felix et al. | 239/687 X |
| 3,536,043 | 10/1970 | Eppe et al. | 118/312 X |
| 3,735,924 | 5/1973 | Wirth | 239/15 |
| 3,827,400 | 8/1974 | Grenfell | 118/421 |
| 3,843,054 | 10/1974 | Kendall et al. | 239/15 |

*Primary Examiner*—Morris Kaplan
*Attorney, Agent, or Firm*—William R. Woodward

[57] ABSTRACT

Powder to be used for coating articles electrostatically is maintained in a fluidized condition in the supply container and in conveyor ducts all the way to a discharge over the inner wall of an annular channel onto the rotating disk of an electrostatic coating machine.

6 Claims, 2 Drawing Figures

Figure 1:
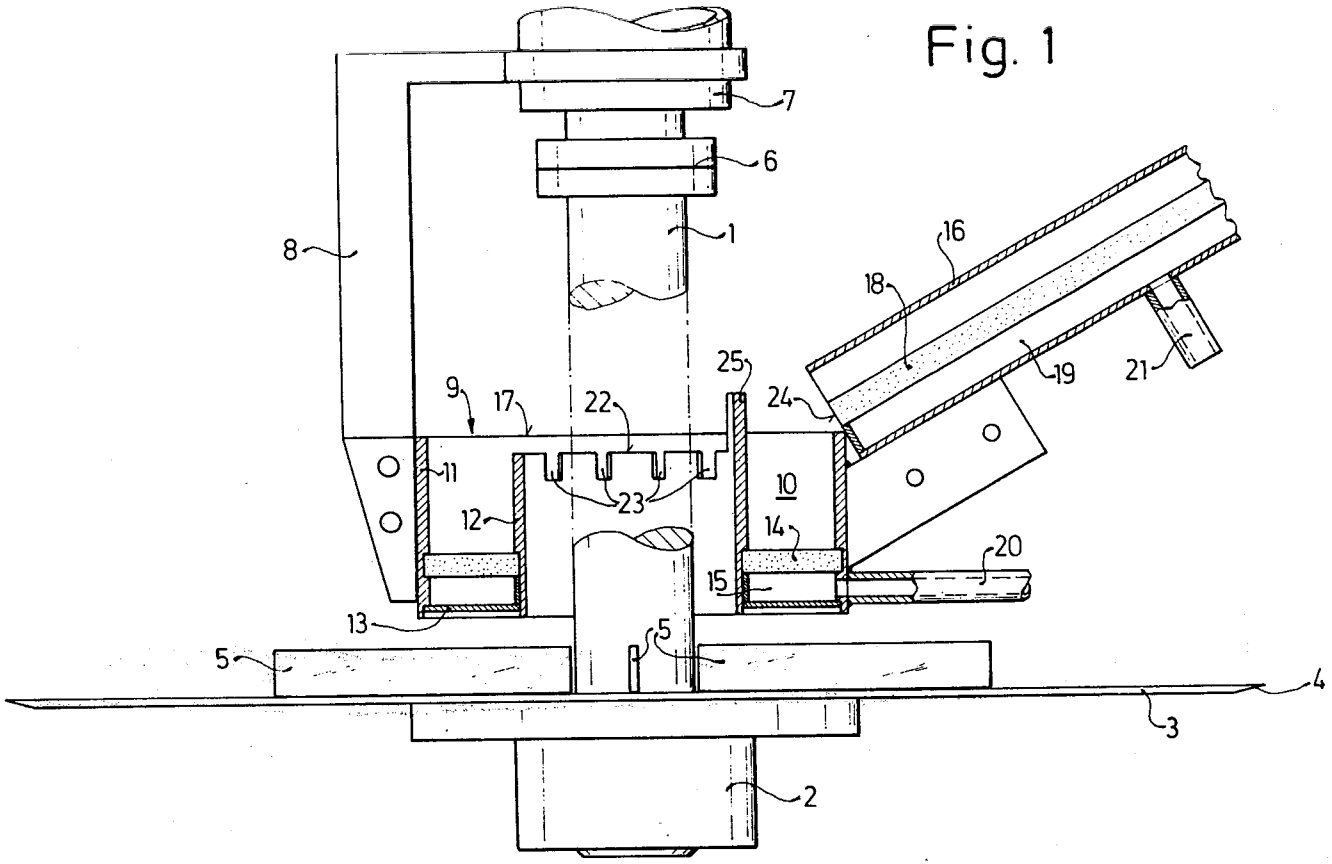

FLUIDIZED POWDER FEED SYSTEM FOR ROTARY DISTRIBUTOR OF ELECTROSTATIC COATING APPARATUS

This invention relates to powder feed systems for electrostatic powder coating machines in which powder distributed by a rotating disk is used to provide a coating on articles in the neighborhood of a disk through the influence of an electrostatic field between the disk and the article. The powder feed for such machines must deliver the coating powder in the region of the upper side of the distributing disk in the neighborhood of the disk axis.

Apparatus of this type operates today mostly with thermosetting resin powders which, after a coating thereof has been provided on the articles to be coated, are heated along with the articles to harden the resin. The hardening of the resin is the result of an internal chemical transformation of the coating material and it therefore follows that this material must be delivered to the distributing apparatus when it is already in a highly reaction-susceptible form. It has been found that the above mentioned chemical transformation, that in practice is intended to take place only after completion of the coating operation, can be prematurely initiated, usually only partially of course, by incidental effects such as impact, friction or slow accidental temperature increases. Such an effect is in many respects damaging to the operation. Not only can the presence of already reacted particles of the coating material in the deposited layer produce a damaging inhomogeniety in the deposited layer, but there are usually also engendered some agglomerates of the coating material within the coating apparatus, either in the form of encrusation inside the conveyor system for the coating powder or in the form of coarse particles. The first of these effects leads to insufficient output or efficiency or even to irregularity in operation of the equipment, whereas the second (coarse particles) leads to a further degradation of the quality of the completed coatings (so called lens formations), which can be remedied, if at all, only by expensive refinishing.

The handling of the coating powder within the coating equipment therefore requires a special degree of care and many arrangements have already been suggested in this regard for the design of equipment, but up to now without fully satisfactory results. The present invention is directed to the same goal, i.e. to mitigate so far as possible the above mentioned damaging influences on the coating powder in a coating apparatus of the type abovementioned.

SUBJECT MATTER OF THE PRESENT INVENTION

Briefly, an annular channel is provided just above and co-axial to the distributing disk of the apparatus for delivery of the coating powder thereto by overflow over its inner walls and means are provided for maintaining the coating powder in the annular channel in the fluidized condition. The annular channel so provided is preferably at least partly open upwards.

A further advantage is obtained in the practice of the invention by the provision of means by which the coating powder is maintained in the fluidized condition on its way to the aforesaid annular channel, such means being provided in the supply container, rate of flow control apparatus, conveyor arrangements, and the like. It is of further advantage to provide perpendicularly upstanding radial vanes on the upper side of the distributing disk of the apparatus, extending outwards from the middle thereof.

With regard to other requirements of the coating apparatus according to the present invention it is required only, corresponding to the usual manner of operation of distributing disks, that the coating material fed to the disk should reach or pass the spray edge or the region of the spray edge with an appreciable radial velocity component and there, if not sooner, be seized by the electrostatic field and be carried away further by it. In this operation, in other and known ways, mechanical and/or pneumatic accelerating forces can be made to assist the operation.

The overflow delivery of the coating powder from the annular channel to the rotating disk below is preferably improved by providing crenelations on the inner wall of the annular channel for better assurance of even distribution of the overflow around the circumference, except that when the powder is conveyed to the annular channel by a spout discharging over its outer wall, it is desirable to provide a raised baffle portion of the inner wall opposite the spout to prevent irregular discharges directly from the spout to the disk.

Figure 2:
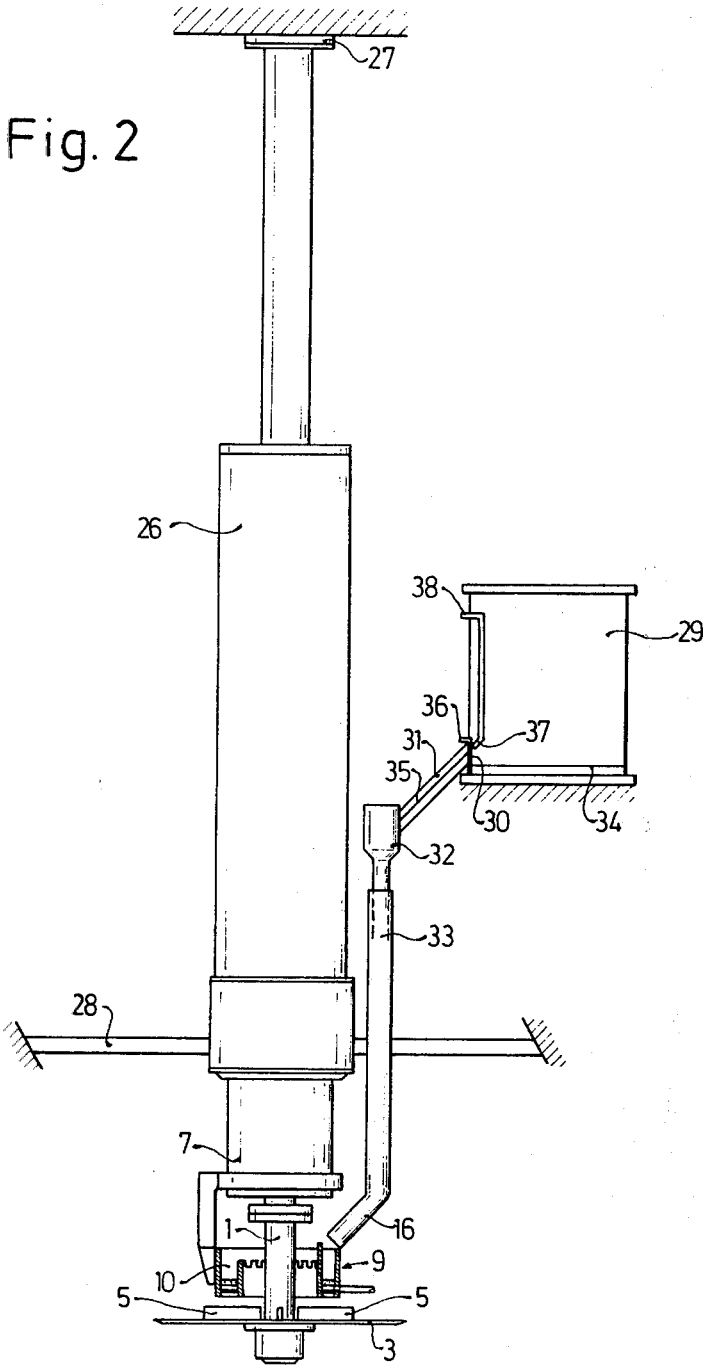

The invention is further described by way of example with reference to the accompanying drawings in which:

FIG. 1. is an elevation view partly in section of a powder feed system according to the invention together with the distributing disk to which powder is delivered thereby, and FIG. 2. shows on a smaller scale, likewise in elevation partly in section, a complete assembly, including a supply container and conveyor duct ahead of the annular feed channel, of a powder feed system according to the invention.

In the drawings there is shown a vertical shaft 1 at the lower end of which a level and circular distributing disk 3 having a sharpened outer edge (spray edge) 4, is afixed by a hub 2. Upright standing radial vanes 5 are provided on the upper side of the distributing disk 3, extending away from the shaft 1, each stretching over a considerable portion of the disk radius.

The shaft 1 extends upwards and is continued by a coupling 6 into a casing 7 in which there are provided bearings and drive means (not shown) for the shaft 1.

A feed device 9 to be described further below is connected to the casing 7 by a holding bracket 8. The feed device 9 consistes essentially of an annular trough 10 above the distributing disk 3 and co-axial to it, composed of a cylindrical outer wall 11, a cylindrical inner wall 12, and a floor 13, inserted between the cylindrical walls and also somewhat above the floor 13, a sieve-like false floor 14. The false floor 14, together with the portions of the circumferencial walls 11 and 12 extending thereabove, defines the above mentioned open annular trough 10 for feeding the coating powder and also forms with the lower floor 13 and the lower portion of the walls 11 and 12 a pressure chamber 15. An oblique duct 16 serves to supply the coating powder to the circular trough 10. The lower end of the duct 16 meets the upper edge 17 of the outer wall 11 and it like-wise is fitted with a sieve-like false bottom 18 and an underlying pressure chamber 19.

The false bottoms 14 and 18 are made of a material provided with air-permeable pores such that compressed air supplied to the corresponding presssure chambers 15 and 19 over piping 20 and 21 respectively can pass upwards through the pores and maintain the coating powder thereabove in a so-called fluidized condition. Thus, the fluidized coating powder flows down the oblique duct 16 at gravity in consequence of the slope of the latter.

The upper edge 22 of the inner wall 12 of the annular feed channel lies a little lower than the upper edge 17 of the outer wall 11 of the same. It is provided with a series of rectangular crenelations the bottoms 23 of which serve as overflow dams, but in the sector opposite the spout end 24 of the oblique feed duct 16, there is a baffle-like raised portion 25 of the inner wall 12. The general view of the spray coating apparatus embodying the invention shown in FIG. 1, shows the shaft 1, the distributing spray disk 3, the powder feed system 9 with its annular channel 10 in turn fed by the duct 16 and also the casing 7 that houses the means (not shown) providing bearings and a drive for the shaft 1.

The casing 7, together with the already mentioned parts afixed to it, in particular the distributing disk 3, can be shifted upwards and downwards by means of a hydraulic cylinder 26 and can be fixed in any vertical position to which it can be so adjusted. The hydraulic cylinder 26 is secured firmly to the building in which it is situated both at it upper end 27 and elsewhere by a cross brace 28.

Likewise afixed to the building structure is a supply container 29 for the coating powder, the outlet 30 of which is connected by an oblique delivery duct 31, to the upper end of a drop tube 32. The lower end of the drop tube 32 is inserted loosely in another drop tube 33 that connects directly to the oblique delivery duct 16. The drop tube 33 is firmly afixed to the casing 7 and is movable therewith, whereas the drop tubes 32, like the supply container 29 remains in fixed position. The concurrent telescopic adjustment of the drop tube 32 and 33 makes it possible to avoid any disturbance of the path of the coating powder through the drop tubes 32 and 33 when the casing 7 and the parts mounted on it are vertically displaced.

As indicated at 34 and 35, the supply container 29 and the oblique deliver duct 31 are both provided with porous bottoms and underlying pressure chambers suitably supplied with compressed air, so that the coating powder can be maintained in fluidized condition also in these parts of the powder feed system of an electrostatic coating apparatus according to the present invention.

Control of the rate of flow of the coating powder is produced by a coarse adjustment provided by a slide 36 at the output 30 of the supply container 29 and by a fine adjustment provided by a constriction valve 37 inside the supply container 29 which is supplied with compressed air over a supply line 38 so that an adjustable air jet is directed against the outlet 30 and thus controllably affects the outflow of the coating powder. Details such as the supply of compressed air to this valve and to the various sieve floors and so on are not shown in the drawings, since their position requires no further explanation.

The coating powder feed for the coating apparatus according to the invention operates as follows. The coating powder is present in the container 29 in the fluidized state and flows through the outlet 30, the sloping duct 31, the drop tubes 32 and 33 and the sloping duct 16 to the ring shaped channel 10 in the feed device 9. From there it flows over the overflow dam 23 on the inner wall 12 of the channel 10 and goes down the distributing spray disk 3. The baffle effect of the raised portion 25 of the inner wall 12 prevents occasionally occurring irregularities in the feed of the coating powder through the oblique duct 16 from gushing directly over the upper edge 22 of the inner wall 12 onto the distributing disk 3.

The coating powder is thus continuously in the fluidized condition on its entire way from the container 29 to the spray disk 3. That means that the above mentioned damaging influences, such as shock, friction and uncontrolled temperature increases are eliminated in an almost ideal manner, because the medium that carries the particles of the coating powder, the air continuously streaming up through the sieve floors, prevents excessively intensive contact of the particles with each other and with the duct walls, and, in addition, has a temperature moderating effect. It is assumed, of course, that a sufficiently low velocity of material transport is produced as a result of choice of operating conditions and of dimensions of the equipment parts. It is not difficult to obtain a material transport velocity of from 1 to 2 meters per second in a powder feed system in accordance with the invention.

The coating powder flowing down onto the distributing spray disk 3 is exposed to the air currents produced by the rotation of the distributing disk when it reaches the neighborhood of the upper surface of the disk. The powder is thereby subjected to a radial acceleration and is therefore propelled towards the spray edge 4 of the disk. In this part of the operation the vanes 5 on the disk 3 can provide additionally a whirling movement serving to smooth out still further the distribution of the particle stream, as may suit the configuration and dimensions of the particular apparatus.

Although the invention has been described with reference to a particular illustrative example, it will be understood that variations are possible within the inventive concept. Thus, for example, the crenelations of the top of the cylindrical wall 12 may be wide as shown, or the lower portions may be narrowed into slots, or V shaped or arcuate indentations may be used instead of rectangular slots. As another example, horizontal slits level with the bottoms of the crenelations may be provided in the raised baffle sector 25 of the wall 12 in order to allow some flow of particles to the disk in that sector.

We claim:

1. Powder feed system for the rotary spray disk of an electrostatic coating apparatus for coating with said powder work pieces caused to pass by the neighborhood of the edge of the disk while subjected to an electric potential relative to said disk, comprising:

an annular channel (10) located above the rotary disk and co-axial thereto and provided with overflow crenelations on its inner wall (17);

said inner wall defining an axial passageway, open at its bottom, whereby to feed said rotary spray disk;

means for pouring a stream of powder into said annular channel, and means (14, 15) for maintaining the coating powder in said annular channel in a fluidized condition whereby to overflow at said crenelations to feed said disk.

2. Powder feed system as defined in claim 1 in which said channel is open at the top.

3. Powder feed system as defined in claim 1 in which said means for pouring a stream of powder into said annular channel includes means (16, 18, 19) for delivering said powder to said channel in fluidized condition.

4. Powder feed system as defined in claim 1 comprising also a supply container (29), a rate of powder delivery control means (30, 36, 37) and conveyor ducts (16, 31) and means for maintaining the coating powder in fluidized condition throughout its path in said powder feed system to said means for pouring a stream of powder into said annular channel.

5. Powder feed system as defined in claim 1, in which the upper surface of said disk (3) is provided with vanes (5) standing vertically and oriented radially with respect to said disk and leading outward from substantially the center of said disk.

6. Powder feed system as defined in claim 1, in which the said annular channel comprises a cylindrical outer wall (11), a cylindrical inner wall (12), a floor member (13) connecting the aforesaid inner and outer walls, a gas-permeable false floor (14) above said floor member (13) and defining therewith a pressure chamber (15) and a compressed air supply line (20) for supplying compressed air to said pressure chamber (15), in which system, further, said means for pouring a stream of powder into said annular channel includes an input spout duct (16) leading over said upper wall of said annular channel, and in which system the inner wall (12) of said annular channel (10) is slightly lower than the outer wall (11) thereof except opposite said input spout channel (16) where it has a raised baffle portion (25) and the top (22) of said inner wall (12) is provided with a series of crenelations (23) except in said raised baffle portion (25) serving as outlets for said coating powder for delivery of said coating powder to said disk.

* * * * *

UNITED STATES PATENT AND TRADEMARK OFFICE

CERTIFICATE OF CORRECTION

PATENT NO. : 3,942,721

DATED : March 12, 1976

INVENTOR(S) : Hermann WIRTH and Lothar MULLER

It is certified that error appears in the above-identified patent and that said Letters Patent are hereby corrected as shown below:

In claim 6, column 6 of the patent, line 7, change "upper wall" to -- outer wall --.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*